United States Patent [19]

Egan

[11] Patent Number: 4,763,797

[45] Date of Patent: Aug. 16, 1988

[54] SKI RACK

[76] Inventor: George E. Egan, 371 Yorkshire, Colgate, Wis. 53017

[21] Appl. No.: 86,557

[22] Filed: Aug. 14, 1987

[51] Int. Cl.[4] ..... A47F 5/08; A47F 7/00

[52] U.S. Cl. ..... 211/70.5; 211/89; 211/94; 248/316.3

[58] Field of Search ..... 211/94, 60.1, 70.6, 211/70.5, 89, 35; 248/316.3

[56] References Cited

U.S. PATENT DOCUMENTS

| | | | |
|---|---|---|---|
| 1,589,616 | 6/1926 | Alford | 248/316.3 X |
| 2,695,105 | 11/1954 | Mitchell | 211/94 X |
| 3,178,141 | 4/1965 | Bloom | 248/316.3 X |
| 4,635,801 | 1/1987 | Oren | 211/94 X |

FOREIGN PATENT DOCUMENTS

| | | | |
|---|---|---|---|
| 285862 | 3/1931 | Italy | 211/70.6 |

*Primary Examiner*—Robert W. Gibson, Jr.

*Attorney, Agent, or Firm*—Andrus, Sceales, Starke & Sawall

[57] ABSTRACT

A ski rack for mounting on a wall or other supporting surface includes a pair of spaced top and bottom rails having a gap therebetween. The rails are affixed at their ends to end blocks, for maintaining the width of the gap. A plurality of sets of opposed retainer blocks are provided along the length of the frame, and are connected to the frame through the gap between the top and bottom rail portions. The retainer blocks have face portions adapted to engage the diverging edge portions of the ski as the ski is slid downwardly between the retainer blocks. The ski is retained on the rack by such engagement of the face portions of the blocks with the diverging edge portions of the skis. The ski is removed by moving the ski upwardly to disengage the edge portions from the face portions of the opposed retainer blocks. The retainer blocks are movable toward and away from each other so as to accommodate varying widths of skis.

10 Claims, 1 Drawing Sheet

SKI RACK

BACKGROUND AND SUMMARY

This invention relates to a ski rack for mounting on a wall or other supporting surface to hold and store skis or the like when not in use.

The prior art shows a number of devices useful for storing skis in an upright position when not in use. For example, U.S. Pat. No. 3,330,573 to Sieloff discloses a ski rack having top and bottom clamping members, with a camber block therebetween, all of which are mounted on a wall. The bottom of a ski is inserted into the bottom clamping member, after which the ski is forced into an opening in the top clamping member against an outward bias provided by camber block 15. Thereafter, a pivotable bar latch is placed into position to retain the top portion of the ski within the opening provided in the top clamping member.

The disadvantage to the structure shown in the Sieloff patent lies in the number of discrete steps which must be performed in order to place the ski in position on the rack, and therefore which must be performed in reverse order to remove the ski from the rack.

The present invention provides a ski rack of simple and efficient design, which takes advantage of a feature universally found in skis of any type, viz., the diverging edges of the ski as they extend from the rear tip portion to the front tip portion. That is, the ski rack of the present invention provides a means for engaging the diverging edges of the ski to retain the ski in its storage position. This aspect of the invention provides a simple and effective manner of retaining the ski on the rack, and involves a minimal number of steps in placing the ski on, and removing the ski from, the rack.

In accordance with various aspects of the invention, a rack for holding one or more skis or other elongated objects, each of which has a pair of spaced edges which extend in a divergent relation to one another along at least a portion of their length, includes a ski rack frame adapted for mounting on a supporting surface, such as a wall or the like. Broadly, the ski rack of the invention includes retainer means connected to the frame for retaining the ski on the frame by engagement with the diverging edge portions of the ski. More specifically, the retainer means comprises a pair of opposed members disposed one on each side of the ski, which are adapted to engage the diverging edge portions of the ski when it is moved between the opposed members in a manner such that the diverging edge portions are brought into contact with the opposed members. The opposed members may be mounted on the frame for movement toward and away from each other to accommodate different widths of skis to be stored. Furthermore, the opposed members may be mounted for pivotal movement with relation to the frame to accommodate the movement of the ski therebetween.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
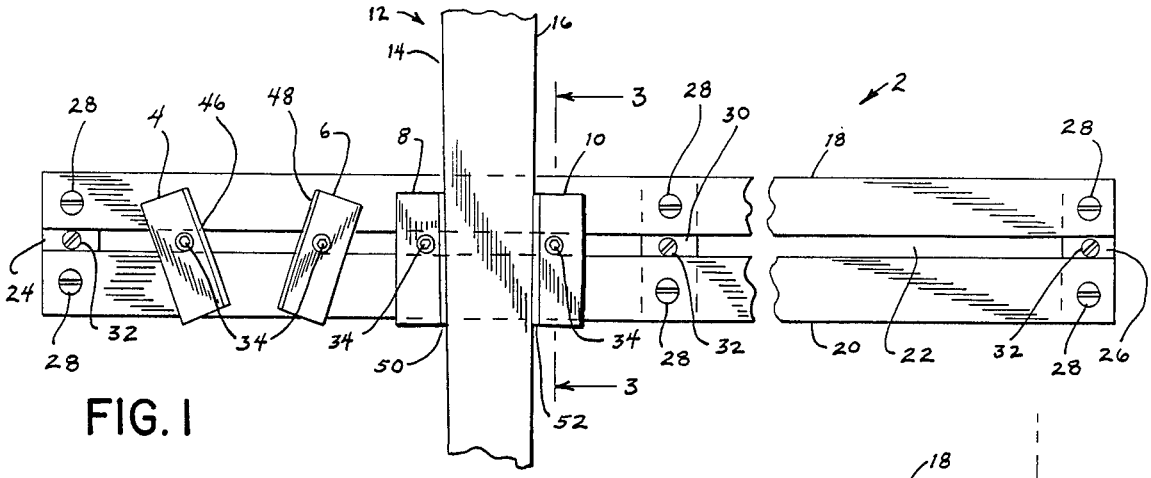
FIG. 1 is a front elevation view of a ski rack according to the present invention.

As shown in FIG. 1, the ski rack of the present invention generally includes a frame 2, and a plurality of sets of retainer blocks, such as 4, 6 and 8, 10, mounted thereto. Each set of blocks, such as 8, 10, are adapted to receive an elongated object therebetween, such as a ski 12. Ski 12 has a pair of spaced edge portions 14, 16 which, along at least a portion of their length, extend in a diverging relation to one another. That is, as shown in FIG. 1, ski edge portions 14 and 16 are closer together at the lower end of ski 12, i.e. below frame 2, than at the upper end of ski 12, i.e. above frame 2. Diverging edge portions 14, 16 extend from the rear tip portion of ski 12 to the front tip portion of ski 12 in a diverging relation along substantially the entire length of ski 12. In the case of downhill type skis, edge portions 14, 16 diverge more sharply than in the case of cross-country type skis.

Frame 2 includes a pair of spaced elongated rails, such as a top rail 18 and a bottom rail 20. A gap 22 is thereby provided between top rail 18 and bottom rail 20. End blocks 24, 26 are provided at the ends of rails 18, 20. Rails 18, 20 are rigidly affixed to end blocks 24, 26 by any satisfactory means, including mechanical fasteners such as screws 28 or the like. An intermediate block 30 is provided intermediate the length of rails 18, 20, to provide stability to the frame structure and to ensure that gap 22 is maintained at a constant width across frame 2 between end blocks 24 and 26. Again, top and bottom rails 18, 20 are connected to intermediate block 30 by any suitable means, such as by screws 28.

Frame 2 is adapted to be mounted on a supporting surface, such as a wall, by any satisfactory means. As shown in FIG. 1, screws 32 are provided at end blocks 24, 26 and at intermediate block 30. Screws 2 are adapted to be connected to the supporting surface, such as into the stud of a standard frame wall to provide a secure support for frame 2.

The retainer blocks, such as 4, 6 and 8, 10, are mounted to frame 2 for slidable movement along gap 22 between top rail 18 and bottom rail 20. As detailed in FIG. 3, a shoulder screw 34 extends through an opening provided in retainer block 10, and has a threaded portion 35 extending through gap 22 to the rear of top and bottom rails 18, 20. Shoulder screw 34 has an Allen type head 36, which is adapted for placement within a mating opening provided in retainer block 10. A shank portion 37 of shoulder screw 34 extends through retainer block 10, and an end 38 of shank portion 37 bears against a washer 39, which has a central opening of a diameter smaller than that of end 38 of shank portion 37. Threaded portion 35 of shoulder screw 34 extends through gap 22, and projects outwardly of a plane defined by the rear sides of top and bottom rails 18, 20. A washer 40 is adapted for placement over the projecting end of threaded portion 35 of shoulder screw 34 and for abutment against the rear sides of top and bottom rails 18, 20 adjacent gap 22. A nut 41 is adapted for threadable engagement with the projection of threaded portion 35 of shoulder screw 34.

Each of retainer blocks 4, 6 and 8, 10 are provided with a similar mechanism for mounting of blocks 4, 6 and 8, 10 to frame 2.

Figure 3:
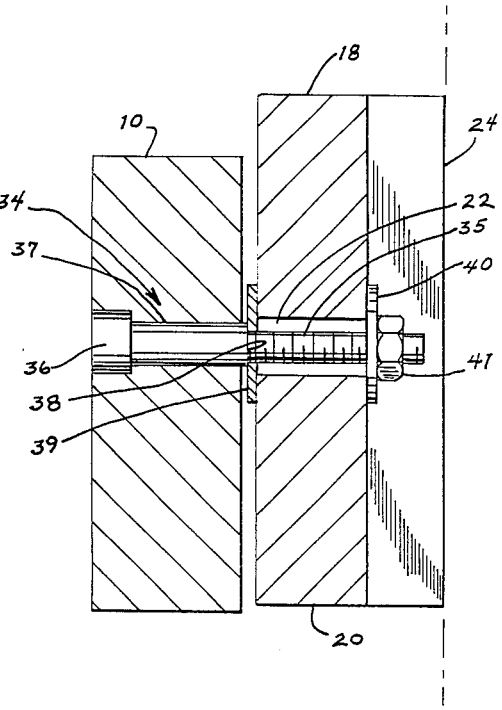
FIG. 3 is a sectional view taken generally along line 3—3 of FIG. 1.
Figure 2:
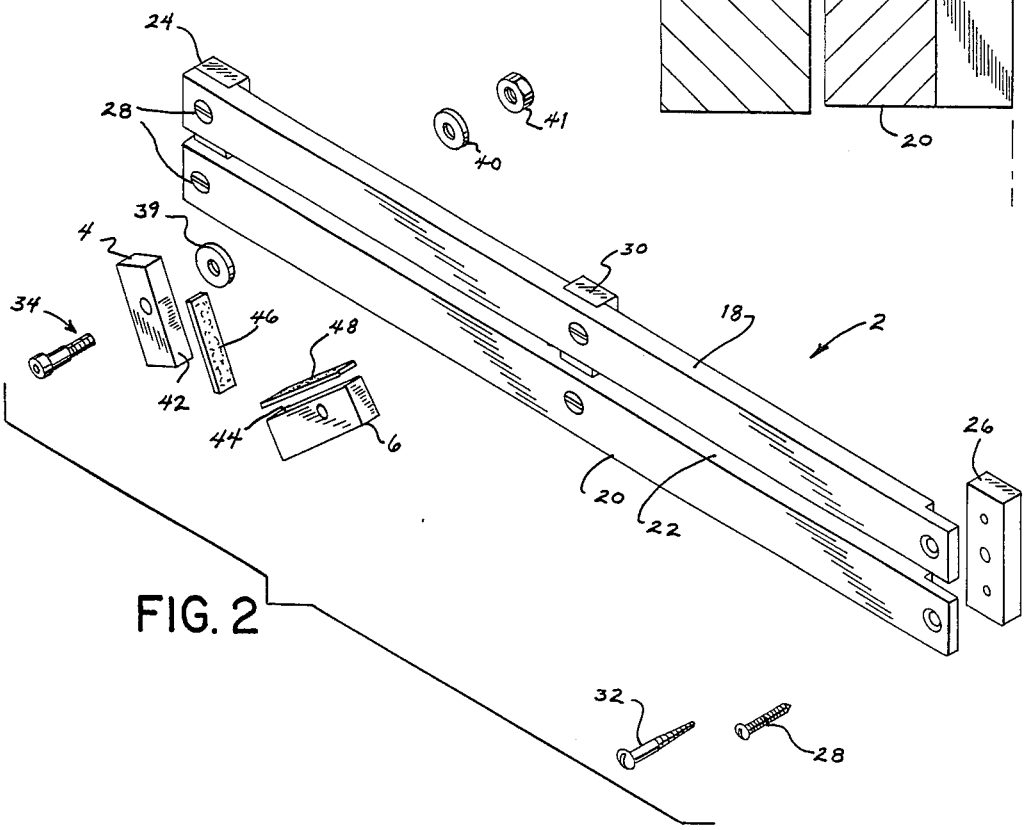
FIG. 2 an exploded perspective view of a ski rack constructed according to the invention, showing only one set,of opposed ski-engaging members.

Due to the above-described construction as shown in FIG. 3, retainer blocks 4, 6 and 8, 10 may be selectively positioned along the length of gap 22. The turning down of shoulder screw 34 provides a clamping .effect on top and bottom rails 18, 20 between washers 39 and 40, which secures the block in the position selected. At the same time, block 10 is free to rotate on shank portion 37 of shoulder screw 34.

As shown in FIG. 1, shoulder screws 34, which extend through retainer blocks 4, 6 and 8, 10, are disposed on each block so as to be off center relative to the center of the block. That is, with reference to FIG. 1, shoulder screw 34 is disposed above and to the right of the center of retainer block 4. In this manner, when retainer block 4 is not engaged with a ski, such as 12, retainer block 4 pivots about shoulder screw 34 due to a gravity bias so that its bottom portion is disposed toward opposed retainer block 6. Similarly, shoulder screw 34 extends through retainer block 6 at a point above and to the left of the center of retainer block 6. When not engaged with a ski, the bottom portion of retainer block 6 is gravity biased toward opposed retainer block 4. In this manner, retainer blocks 4 and 6 define a converging passage for receiving an elongated object, such as a ski, therebetween.

Retainer block 4 includes a face portion 42, which faces opposed block 6. Likewise, block 6 is provided with a face portion 44, which faces opposed block 4. Face portions 42, 44 of blocks 4, 6 are provided with pads 46, 48, respectively. Pads 46 and 48 may be composed of any suitable material which may be satisfactorily attached to blocks 4 and 6, and which will not mar or scrape the edge portions of a ski which is engaged therebetween. In particular, pads 46, 48 may be made of felt or of a rubber composition material. Similarly, the face portions of blocks 8 and 10 are provided with pads 50, 52, which engage edge portions 14, 16 of ski 12, respectively.

In operation, the user first selectively positions the sets of opposed blocks, such as 4, 6 and 8, 10, along gap 22 so that an appropriate space is provided between the sets of block to accommodate ski 12 or other such elongated object therebetween. The blocks are then fixed in their selected positions by means of shoulder screw 34 and its associated washers and nut. After securing the retainer blocks, ski 12 is placed between the opposed retainer blocks at a point where the width of the ski between its diverging edges is less than that of the space between the retainer blocks. For example, the rear tip portion of ski 12 may be placed above the passage formed by the opposed retainer blocks. The ski 12 is then slid downwardly, so that its rear tip portion engages the bottom portions of the retainer blocks, such as 4, 6, which are gravity biased toward each other. Upon such engagement, the retainer blocks are pivoted about their respective shoulder screws 34 in opposite rotational directions, and ski 12 is moved downwardly through the passage between the retainer blocks. With continued downward movement of ski 12, edge portions 14 and 16 eventually come into full contact with the face portions of the retainer blocks. This causes the face portions of the retainer blocks to abut and come into substantial alignment with edge portions 14 and 16 of ski 12, and to effectively sandwich ski 12 therebetween. This is shown in FIG. 1 with respect to retainer blocks 8 and 10. To remove ski 12 from between the opposed retainer blocks, the ski is simply lifted upwardly so as to disengage the face portions of the retainer blocks from the edge portions of the ski. The retainer blocks then assume their original position, defining a converging passage for receiving a ski therebetween.

It is understood that any number of sets of opposed retainer blocks can be disposed along the length of frame 2, to accommodate storage of a like number of skis. It is also understood that, while the invention has been described with reference to storage of skis, the invention is capable of holding and storing any suitable article having edge portions which extend in a divergent relation to one another along at least a portion of their length.

The structural components of the ski rack of the present invention may be made of any suitable material, such as metal, plastic or wood.

It is understood that various alternatives and modifications are contemplated as being within the scope of the following claims particularly pointing out and distinctly claiming the subject matter regarded as the invention.

I claim:

1. A rack for holding one or more skis or other elongated objects, each said elongated object having a pair of spaced edges which, along at least a portion of their length, extend in an upwardly divergent relation to one another, comprising:

a rack frame; and retainer means comprising a pair of opposed blocks connected to said frame, each said block having a substantially flat face spaced from a like face provided on the opposed block, said opposed faces of said blocks adapted to engage the divergent edges of said elongated object, wherein said opposed blocks are connected to said frame so as to be pivotable, so that said opposed blocks pivot in response to movement of said upwardly divergent edges of said elongated object therebetween and engagement of said upwardly divergent edges with said opposed faces of said blocks so that said opposed faces become aligned with and abut said divergent edges of said elongated object during said movement of said elongated object and, due to the engagement of said divergent edges between said opposed substantially flat faces of said blocks, said elongated object is retained on said rack.

2. The invention according to claim 1, wherein said opposed blocks are movable to varying positions on said frame so as to accommodate varying widths of said elongated objects therebetween.

3. The invention according to claim 1, wherein said frame comprises top and bottom spaced elongated rails.

4. The invention according to claim 3, wherein said opposed blocks are slidably connected to said frame through a gap disposed between said rails and movable to selected positions along the length of said frame to accommodate varying widths of said elongated objects therebetween.

5. A rack for holding and storing one or more skis adjacent a supporting surface, such as a wall, said skis each having a pair of spaced edges which, along at least a portion of their length, extend in an upwardly divergent relation to one another, comprising:

a rack frame;

mounting means for mounting said rack frame on said supporting surface; and retainer means connected to said frame for retaining said skis on said frame, said retainer means comprising a plurality of pairs of opposed blocks disposed along the length of said frame and connected thereto, each said block in said pair of opposed blocks including a substantially flat face portion adapted to engage one of said upwardly diverging edges on said ski, each said pair of opposed blocks being adapted to receive a ski therebetween so that said pair of opposed blocks acts to sandwich said ski between said face portions when said ski is placed between said opposed blocks and moved so as to bring said upwardly diverging edges into engagement with said substantially flat face portions for retaining said ski on said frame.

6. The invention according to claim 5, wherein, when said diverging edges are brought into engagement with said face portions of said opposed blocks so as to sandwich said ski therebetween, said face portions are disposed at an angle corresponding to the angle of said diverging edges of said ski and are in substantial alignment with and in abutting relation to said diverging edges.

7. The invention according to claim 6, wherein each said block in said pairs of opposed blocks is connected to said rack frame so as to be pivotable so that, when said ski is moved therebetween and said diverging edges are brought into engagement with said face portions of said opposed blocks, one said block pivots in a clockwise direction and the other said block pivots in a counterclockwise direction until alignment of said face portions with said diverging edges of said ski and engagement of said ski therebetween.

8. The invention according to claim 7 wherein each said block pivots about a pivot axis offset from the center of said block so that, when not engaging said diverging edge portions of said ski, said block is suspended at said pivot axis so that the bottom portion of said block is disposed toward the opposing block to define a converging passageway for receiving said ski between said blocks.

9. The invention according to claim 5, wherein said rack frame comprises a top rail portion spaced from a bottom rail portion, with a gap being disposed between said top and bottom rail portions, and wherein said plurality of pairs of opposed blocks are connected to said rack frame through said gap.

10. The invention according to claim 5, wherein said sets of opposed blocks are connected to said rack frame so as to be movable toward and away from each other to accommodate varying ski widths.

* * * * *

UNITED STATES PATENT AND TRADEMARK OFFICE

CERTIFICATE OF CORRECTION

PATENT NO. : 4,763,797

DATED : August 16, 1988

INVENTOR(S) : George E. Egan

It is certified that error appears in the above-identified patent and that said Letters Patent is hereby corrected as shown below:

ON THE TITLE PAGE:

At [56], References Cited, Insert ---3,330,573 7/1967 Sieloff 280/11.37---;

At [56], References Cited, Insert ---4,222,490 9/1980 Wood, Jr. 211/60---;

At [56], References Cited, Insert ---4,245,745 1/1981 Verelle et al 211/8---;

At [56], References Cited, Insert ---4,319,686 3/1982 Avocat 211/60---;

At [56], References Cited, Insert ---4,635,800 1/1987 Stempin 211/70.5---;

Col. 1, line 64, After "rack" insert ---constructed---;

Col. 1, line 68, After "set" delete "," (comma);

Claim 8, col. 6, line 7, After "7" insert ---,--- (comma);

Claim 10, col. 6, line 22, Delete "sets" and substitute therefor ---pairs---

Signed and Sealed this

Twenty-eighth Day of March, 1989

*Attest:*

*Attesting Officer*

DONALD J. QUIGG

*Commissioner of Patents and Trademarks*